US006151754A

United States Patent [19]

Chen

[11] Patent Number: 6,151,754

[45] Date of Patent: Nov. 28, 2000

[54] DOOR STOP

[76] Inventor: Ping-Yen Chen, P.O. Box 82-144, Taipei, Taiwan

[21] Appl. No.: 09/277,840

[22] Filed: Mar. 29, 1999

[51] Int. Cl.[7] ..... E05F 5/06; A44B 19/00; E05C 1/04; B25G 3/18

[52] U.S. Cl. ..... 16/85; 16/86 B; 24/652; 24/657; 292/341.5; 292/42; 403/328

[58] Field of Search ..... 16/85, 85 B, 82; 292/341.5, 42, 9, DIG. 15; 24/652, 657; 403/328, 306, 324

[56] References Cited

U.S. PATENT DOCUMENTS

| | | | |
|---|---|---|---|
| 530,862 | 12/1894 | Teed | 16/82 |
| 655,127 | 7/1900 | Stock | 16/85 |
| 711,812 | 10/1902 | Armstrong | 16/85 |
| 984,118 | 2/1911 | Wilcox | 16/85 |
| 1,618,851 | 2/1927 | Thunberg et al. | 292/341.5 |
| 1,965,672 | 7/1934 | Seitz | 16/86 B |
| 2,117,947 | 5/1938 | Rome et al. | 292/352 |
| 2,629,156 | 2/1953 | Kamens et al. | 24/652 |
| 4,433,854 | 2/1984 | Smith | 403/328 |

*Primary Examiner*—Anthony Knight
*Assistant Examiner*—Vishal Patel
*Attorney, Agent, or Firm*—A & J

[57] ABSTRACT

A door stop, which includes a locating block fixedly mounted on the wall, the locating block having a longitudinal front hole and two transverse side holes in communication with the front hole, two locating pins respectively mounted in the side holes and forced by a respective spring member into the front hole, and a necked bolt fixedly mounted on the door, the bolt having a ball head and a neck adjacent to the ball head, wherein the locating pins are forced backwards by the ball head of the bolt and then pushed forwards by the respective spring members into engagement with the neck at the bolt when the door is opened to force the bolt into the longitudinal front hole at the locating block.

7 Claims, 3 Drawing Sheets

DOOR STOP

BACKGROUND OF THE INVENTION

The present invention relates to a door stop, and more particularly to such a door stop which is durable in use and, achieves a positive positioning effect.

A door stop is a device for holding a door open. FIG. 3 shows a door stop according to the prior art. This structure of door stop comprises a ball socket B fixedly mounted on the wall, a magnetic lining plate B1 fixedly mounted inside the ball socket B, and a metal stop rod A fixedly mounted on the door 7 and having a ball head A1 fitting the ball socket B. When the door 7 is opened, the ball head A of the stop rod A is forced into the ball socket B and attracted by the magnetic lining plate B1. This structure of door stop is not durable in use because the magnetic lining plate B1 receives a compact each time the door 7 is opened to force the ball head A of the stop rod A into the ball socket B. FIG. 4 shows another structure of door stop according to the prior art. This structure of door stop comprises a hook D fixedly mounted on the door, a stop rod C fixedly mounted on the door 7, and a retainer ring C1 pivoted to the stop rod C. When the door 7 is opened, the retainer ring C1 is hung on the hook D to hold the door 7 open. When closing the door 7, the retainer ring C1 is disconnected from the hook D. This structure of door stop is not satisfactory in function. Because the retainer ring C1 can be vibrated when hung on the hook D, a noise is produced when the door 7 is vibrated. Further, it is inconvenient to hang the retainer ring C1 on the hook C after opening of the door 7, or to disconnect the retainer ring C from the hook C before closing the door 7.

SUMMARY OF THE INVENTION

The present invention has been accomplished to provide a door stop which eliminates the aforesaid drawbacks. It is one object of the present invention to provide a door stop which is durable in use. It is another object of the present invention to provide a door stop which produces less impact when holding the door open. It is still another object of the present invention to provide a door stop which is convenient in use. To achieve these and other objects of the present invention, there is provided a door stop comprised of a locating block fixedly mounted on the wall, the locating block having a longitudinal front hole and two transverse side holes in communication with the front hole, two locating pins respectively mounted in the side holes and forced by a respective spring member into the front hole, and a necked bolt fixedly mounted on the door, the bolt having a ball head and a neck adjacent to the ball head. The locating pins are forced backwards by the ball head of the bolt and then pushed forwards by the respective spring members into engagement with the neck at the bolt to hold the locating bolt in the locating block when the door is opened to force the bolt into the longitudinal front hole at the locating block. When the door is turned from the opening position to the closing position, the bolt is pulled outwards from the longitudinal front hole at the locating block, and the locating pins are backwards to compress the respective spring members for enabling the locating bolt to be disconnected from the locating block.

DETAILED DESCRIPTION OF THE PREFERRED EMBODIMENT

Figure 1:
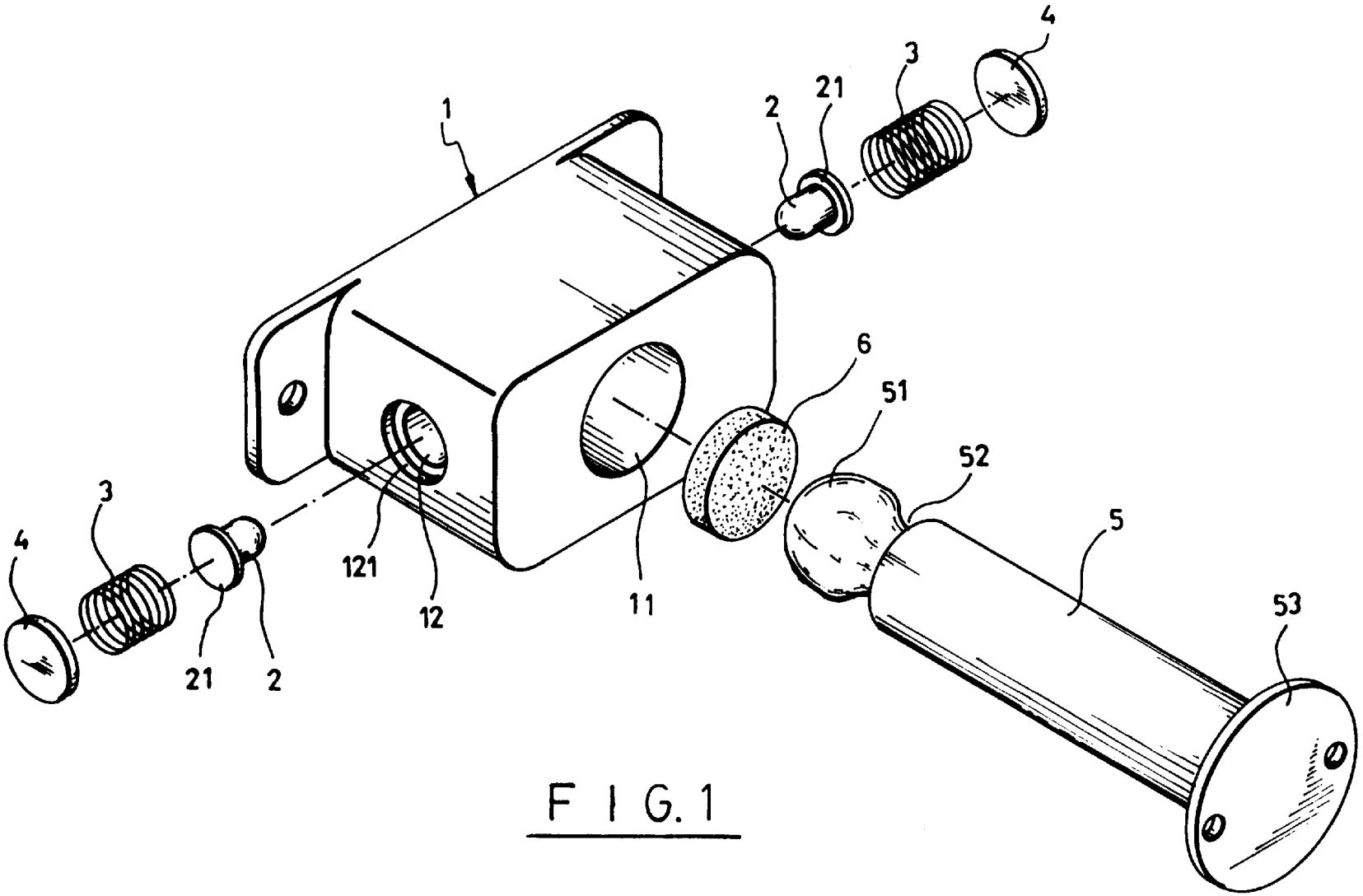
FIG. 1 is an exploded view of a door stop according to the present invention.
Figure 2:
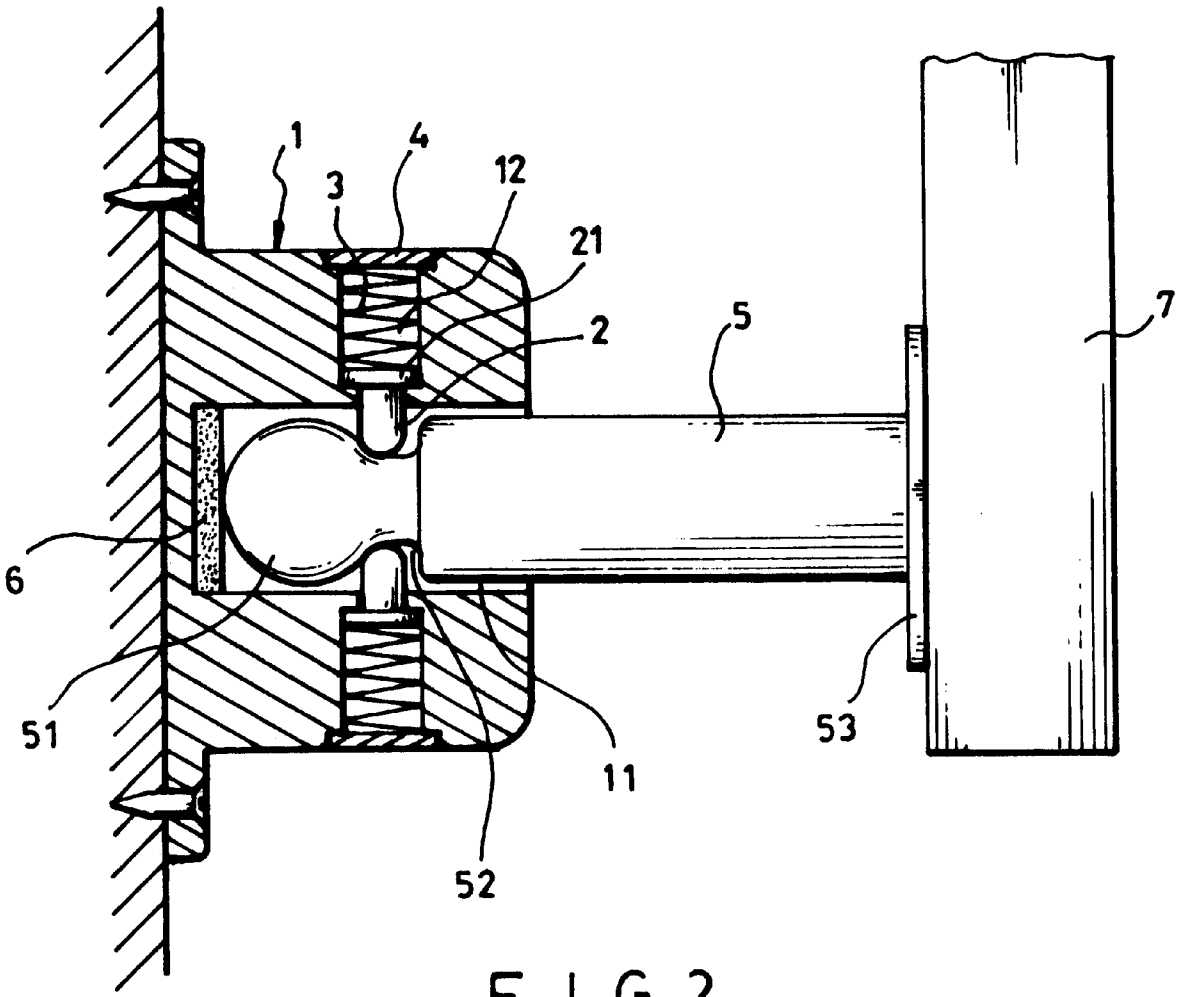
FIG. 2 is a sectional view of the present invention, showing the locating pins engaged into the neck at the bolt.
Figure 3:
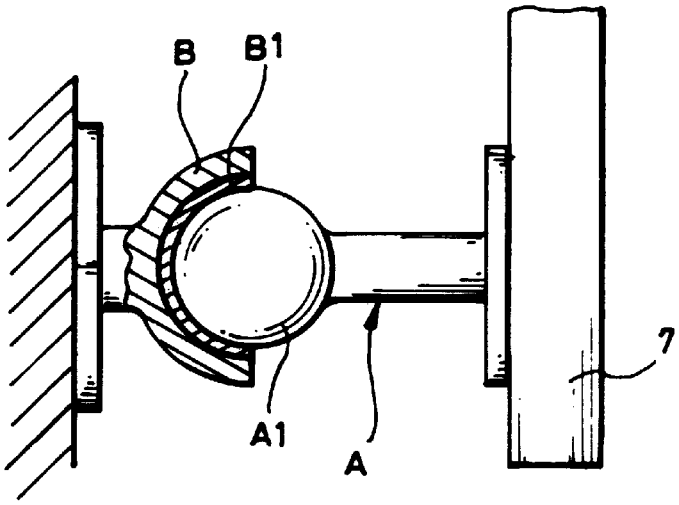
FIG. 3 is a sectional view of a door stop according to the prior art.
Figure 4:
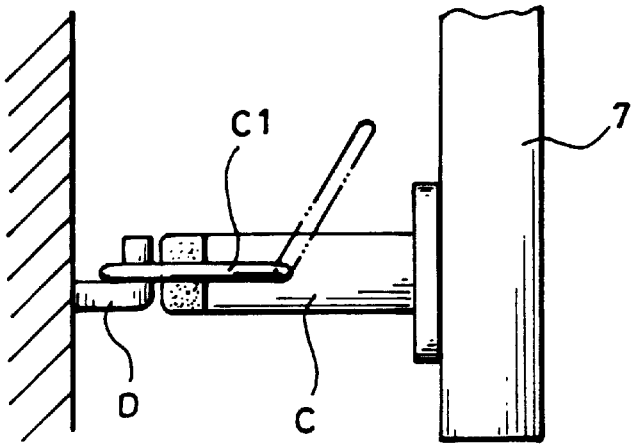
FIG. 4 is a sectional view of another structure of door stop according to the prior art.

Referring to FIGS. 1 and 2, a door stop in shown comprised of a locating block 1, and a bolt 5. The locating block 1 is fixedly mounted on the wall, having a longitudinally extended front hole 11 at its front side and two transversely extended stepped side holes 12 at its two opposite lateral sides in communication with the front hole 11. A cushion 6 is fixedly mounted inside the front hole 11. The cushion 6 is preferably made of rubber, and adhered to the inside wall of the locating block 1 inside the front hole 11. Two locating pins 2 are respectively mounted in the stepped side holes 12, and partially inserted into the front hole 11. The stepped side holes 12 each have an outer section of greater diameter and an inner section of smaller section. The locating pins 2 each have a head 21 of diameter greater than the inner section of each of the stepped side holes 12 but smaller than the outer section of each of the stepped side holes 12. The locating block 1 further comprises two locating grooves 121 respectively provided at its two opposite lateral sides around the outer end of the outer section of each of the stepped side holes 12. Two caps 4 are respectively fixedly mounted within the locating grooves 121 in flush with the outside wall of the locating block 1 to close the stepped side holes 12. Two compression springs 3 are respectively mounted inside the stepped side holes 12, and stopped between the respective caps 4 and the head 21 of each of the respective locating pins 2. The compression springs 3 impart a forward pressure to the locating pins 2, causing the locating pins 2 to be respectively perpendicularly inserted into the front hole 1 from two opposite sides. The bolt 5 comprises a flat mounting base 53 disposed at one end of its cylindrical body and fixedly fastened to the door 7, a ball head 51 disposed at the other end of its cylindrical body, and a neck 52 connected between the ball head 51 and its cylindrical body. The neck 52 is a smoothly curved groove around the periphery of the bolt 5.

When the door 7 is opened, the bolt 5 is inserted into the front hole 11 at the locating block 1. When the bolt 5 is inserted into the front hole 11 at the locating block 1, the locating pins 2 are respectively forced outwards by the ball head 51 of the bolt 5 to compress the compression spring 3 and to let the ball head 51 pass to the cushion 6. After the ball head 51 reached the cushion 6, the locating pins 2 are respectively forced forwards by the respective compression springs 3 to engage the neck 52 at the bolt 5, and to stop the bolt 5 from backwards movement. When the door 7 is pulled backwards from the opening position to the closing position to remove the bolt 5 from the front hole 11 at the locating block 1, the locating pins 2 is forced backwards by the smoothly curved peripheral wall of the ball head 51 to compress the compression springs 3, enabling the ball head 51 to be disengaged from the constraint of the locating pins 2.

What the invention claimed is:

1. A door stop comprising:

a locating block fixedly mounted on a wall, said locating block comprising a longitudinal front hole, and at least one transverse side hole respectively intersected with said longitudinal front hole;

a bolt fixedly mounted on a door being turned between a closing position and an opening position relative to the wall, said bolt comprising a neck; and at least one retainer means respectively mounted in said at least one transverse side hole in said locating block to secure said bolt to said locating block when the neck of said bolt is inserted into the longitudinal front hole at said locating block upon opening of the door, said at least one retainer means each comprising a spring member mounted in one of said at least one transverse side hole, and a locating pin mounted in one of said at least one transverse side hole and forced by said spring member into the longitudinal front hole in said locating block to engage the neck of said bolt.

2. The door stop of claim 1 wherein said locating block comprises two transverse side holes axially aligned two opposite sides and respectively intersected with said longitudinal front hole.

3. The door stop of claim 1 wherein each of said at least one retainer means further comprises a cap fixedly closed one of said at least one transverse side hole to hold down the respective spring member.

4. The door stop of claim 1 wherein said at least one transverse side hole each have an outer section of greater diameter and an inner section of smaller section, and the locating pin of each of said retainer means comprises a head at one end of diameter greater than the inner section of each of said at least one transverse side hole but smaller than the outer section of each of said at least one transverse side holes.

5. The door stop of claim 1 further comprising a cushion fixedly mounted inside an inner bottom wall in said longitudinal front hole.

6. The door stop of claim 1 wherein said bolt has a ball head at one end thereof remote from the door.

7. The door stop of claim 1 wherein the neck of said bolt is a smoothly curved groove formed around the periphery of said bolt.

* * * * *